US008197050B2

(12) United States Patent
Takekoshi et al.

(10) Patent No.: US 8,197,050 B2
(45) Date of Patent: Jun. 12, 2012

(54) INKJET PRINTING APPARATUS AND INKJET PRINTING METHOD

(75) Inventors: Rie Takekoshi, Kawasaki (JP); Takao Ogata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 621 days.

(21) Appl. No.: 12/331,139

(22) Filed: Dec. 9, 2008

(65) Prior Publication Data

US 2009/0160885 A1 Jun. 25, 2009

(30) Foreign Application Priority Data

Dec. 20, 2007 (JP) ..... 2007-329338
Nov. 27, 2008 (JP) ..... 2008-302847

(51) Int. Cl.
*B41J 2/17* (2006.01)

(52) U.S. Cl. ..... 347/98; 347/6

(58) Field of Classification Search ..... 347/21, 347/14, 15, 86, 101, 104, 98, 6
See application file for complete search history.

(56) References Cited

U.S. PATENT DOCUMENTS 5,843,219 A 12/1998 Griffin et al.
6,074,052 A 6/2000 Inui et al.
7,273,801 B2 * 9/2007 Seki et al. ..... 438/584
7,520,582 B2 * 4/2009 Konno ..... 347/14
7,661,809 B2 * 2/2010 Taniuchi et al. ..... 347/103
2001/0007463 A1 * 7/2001 Hayashi et al. ..... 347/86
2005/0243121 A1 * 11/2005 Onishi ..... 347/21
2006/0293410 A1 * 12/2006 Tokita et al. ..... 523/160

FOREIGN PATENT DOCUMENTS

JP 09-511780 T 11/1997
JP 10-323975 A 12/1998
JP 11-263052 9/1999
JP 2002-321349 A 11/2002
JP 2006-342201 A 12/2006
JP 2007-002122 A 1/2007

OTHER PUBLICATIONS

Office Action in Japanese Application No. 2008-302847, dated Nov. 13, 2009, Japanese Patent Office.
Office Action Appln. No. 2008-302847, Japanese Patent Office, Jun. 22, 2010 (along with English-language translation).

* cited by examiner

*Primary Examiner* — Ellen Kim
(74) *Attorney, Agent, or Firm* — Fitzpatrick, Cella, Harper & Scinto

(57) ABSTRACT

Provided are an inkjet printing apparatus and an inkjet printing method in which a high-quality image free of peeling of an image face can be printed, while an amount of a treatment liquid consumed is reduced. For that purpose, a group of pigment-based inks excellent in wettability with respect to the treatment liquid (small in contact angle with respect to the treatment liquid) are made relatively small in a proportion of the treatment liquid applied to a position to which the pigment-based ink concerned is applied. In contrast, a group of pigment-based inks poor in wettability (great in contact angle with respect to the treatment liquid) are made relatively great in a proportion of the treatment liquid applied to a position to which the pigment-based ink concerned is applied.

9 Claims, 12 Drawing Sheets

| | BLACK INK | LIGHT CYAN INK |
|---|---|---|
| CONTACT ANGLE WITH TREATMENT LIQUID | 35 DEGREES | 12 DEGREES |

FIG.6

| PRINTING DUTY OF TREATMENT LIQUID APPLIED TO SOLID PRINTING OF PIGMENT-BASED INKS | BLACK INK | | LIGHT CYAN INK | |
|---|---|---|---|---|
| | HEIDON | HUMAN FINGERNAIL | HEIDON | HUMAN FINGERNAIL |
| 0 % | × | × | × | × |
| 20 % | × | × | ○ | ○ |
| 40 % | × | × | ○ | ○ |
| 60 % | ○ | ○ | ○ | ○ |
| 80 % | ○ | ○ | ○ | ○ |
| 100 % | ○ | ○ | ○ | ○ |

FIG.9

| | GROUP GREAT IN CONTACT ANGLE (BLACK INK, ETC.) | GROUP SMALL IN CONTACT ANGLE (LIGHT CYAN INK, ETC.) |
|---|---|---|
| PRINTING DUTY OF TREATMENT LIQUID NECESSARY FOR SOLID PRINTING OF PIGMENT-BASED INKS | 60% | 20% |

FIG.10

INKJET PRINTING APPARATUS AND INKJET PRINTING METHOD

BACKGROUND OF THE INVENTION

1. Field of the Invention

The present invention relates to an inkjet printing apparatus and an inkjet printing method in which printing is performed by ejecting a plurality of pigment-based inks and a treatment liquid for improving the performance of an image formed by the pigment-based inks.

2. Description of the Related Art

In recent years, inkjet printing apparatuses have come to be widely used, for example, in exhibition use for general public and trademark print use such as photos, posters and graphic prints, due to the high resolution and high print quality of an image to be printed. In images formed for the above-described exhibition use for general public and trademark print use, there is an increasing demand for improving image qualities such as gloss uniformity and bronzing, in addition to high resolution and high print quality, and there is also an increasing demand for improving fastness of a printed image which indicates the strength and prolonged storage of an image.

In this instance, the bronzing is to an extent in which illumination light reflects color different from that of the illumination light due to a bronzing phenomenon upon regular reflection (mirror reflection) on the surface of a pigment image. It is known that the phenomenon is in particular apparent when cyan ink is used.

Color inks used in an inkjet printing apparatus are roughly classified into dye-based inks and pigment-based inks. The dye-based inks are characterized in that they are higher in transparency and greater in color development than the pigment-based inks because a color dye is dissolved in a water or alcohol-based medium in a molecular state. However, the dye-based inks have a disadvantage that they fade earlier by ultraviolet rays or activated gas in the atmosphere. On the other hand, the pigment-based inks are excellent in resistance to fading when stored for a prolonged period of time.

In recent years, pigment-based inks are able to attain at the same time the original prolonged storage and the high color-development properties comparable to those of dye-based inks due to advancement of manufacturing technology. An inkjet printing apparatus which uses pigment-based inks has come to be widely used mainly in trademark print use such as photos and posters in which printed images are strongly requested to be stored over a longer period of time.

However, particularly in the above-described use in which pigments are used, there is found an ever increasing importance to the problem that the degree of gloss of an image tends to be nonuniform or to the problem of image quality that has been a concern, for example, a bronzing phenomenon typically found on the use of pigment cyan ink. Further, with an increase in exhibition use such as posters, there is posed a new problem on the fragility of fastness of a printed image which indicates the strength and prolonged storage of an image, as compared with offset printed matter.

Hereinafter, a description will be given, as an example, of a problem of scratch resistance among problems of fastness of a printed image.

There is now posed a problem that when pigment-based inks are mainly used to print an image on glossy paper, the image is likely to be damaged even when handling after printing or during display which is a general working step.

FIG. 4B is a schematic diagram illustrating the cross section of a printed image obtained when pigment-based inks are used to perform printing on a printing medium on which an ink receiving layer is formed. Hereinafter, a description will be given, with reference to FIG. 4B, of reasons for an image which is likely to be damaged when formed on glossy paper by using pigment-based inks.

A printing medium used in an inkjet printing apparatus is constituted so that an ink receiving layer 24 is formed on the surface thereof in order to absorb ink on a basic material (not illustrated) such as paper and film. The ink receiving layer 24 contains a great amount of inorganic fine particles such as silica and alumina high in absorbability of an ink solvent for the purpose of inhibiting ink spread or the like. Since printing media such as glossy paper used in printing a photo require a high surface smoothness, inorganic particles in the submicron range are generally used. Therefore, a clearance between inorganic fine particles formed on the ink receiving layer 24 is proportional to the particle size and formed with a fine pore in the submicron range.

On the other hand, a pigment-based ink 25 is an ink in which a color pigment is dispersed as particles of about 100 nanometers. Therefore, where the fine pores of the ink receiving layer 24 are smaller in diameter than color pigment particles, the color pigment particles are unable to enter into the ink receiving layer 24 and retained on the surface as if they were sieved. In general, in printing media such as glossy paper, fine pores of the ink receiving layer 24 are smaller in diameter than color pigment particles, and thereby the pigment-based ink layer 25 is formed on the surface of the ink receiving layer 24.

As described above, since the pigment-based ink layer 25 is formed on the surface of the ink receiving layer 24, the surface of an image is likely to be damaged on application of an external force to the pigment-based ink layer 25. The pigment-based ink layer 25 (image) may be peeled by the external force, depending on a case. Because of the above-described reasons, a problem of scratch resistance may be found dominantly on an image formed by using pigment-based inks.

In dealing with the above problem, it is quite effective in improving the scratch resistance by forming a transparent layer on the surface layer of the pigment-based ink layer 25 on glossy paper to decrease a coefficient of dynamic friction on the surface of an image. Thus, in an inkjet printing apparatus which has been developed recently, there has been proposed a constitution in which printing is performed with the use of glossy paper on which a treatment liquid containing a resin having functions of scratch resistance is used to form a transparent layer.

FIG. 4A is a schematic diagram illustrating the cross section of a printed image on which a treatment liquid is used to form a transparent layer. The treatment liquid is used to form a transparent layer 26 on the uppermost surface so as to coat the pigment-based ink layer 25. Since the pigment-based ink layer 25 is protected by the transparent layer 26, it is possible to obtain a printed image in which the image face is less likely to be peeled or damaged by an external force such as contact with a fingernail and also to improve the scratch resistance. However, the surface is not necessarily coated completely with the treatment liquid as shown in FIG. 4A. The scratch resistance may be improved, if the ink receiving layer is coated with the treatment liquid to such an extent that no external force is directly applied to pigment-based inks although some parts of the layer are not coated.

Japanese Patent Laid-Open No. H11-263052 (1999) has disclosed a method in which a film-formable transparent resin is heated, melted and ejected on an image from nozzles when inkjet printing, thereby coating the image with a transparent layer as a general method for forming the transparent layer 26 by using a treatment liquid. In this method, dots are arranged all over or uniformly on an image to form a transparent layer, thereby protecting the image.

Coating the uppermost surface of an image of pigment-based inks on a printing medium by using a transparent layer is quite effective in improving the scratch resistance and image performance such as gloss uniformity. However, the treatment liquid is applied to an image to be printed with plural colors of pigment-based inks on its whole part of the image, thereby resulting in a relatively greater amount of the treatment liquid compared with amounts of individual colors of pigment-based inks. As a result, such a problem is posed that a tank for a treatment liquid is made larger and the running cost is increased due to a greater consumption of the treatment liquid.

SUMMARY OF THE INVENTION

Therefore, an object of the present invention is to provide an inkjet printing apparatus and an inkjet printing method in which image performance is improved, while an amount of a treatment liquid consumed is reduced.

According to an aspect of the present invention, an inkjet printing apparatus for printing an image by applying a plurality of pigment-based inks and a treatment liquid for improving a performance of the image formed by the plurality of pigment-based inks to a printing medium, comprising: a controller capable of executing processing for controlling an applying amount of the treatment liquid in such a manner that a proportion of an applying amount of the treatment liquid to that of a pigment-based ink relatively small in contact angle with respect to the treatment liquid is made smaller than a proportion of an applying amount of the treatment liquid to that of a pigment-based ink relatively great in contact angle with respect to the treatment liquid.

According to another aspect of the present invention, an inkjet printing method for printing an image by applying a plurality of pigment-based inks and a treatment liquid for improving a performance of the image formed by the plurality of pigment-based inks to a printing medium, comprising the steps of: applying the plurality of pigment-based inks to the printing medium; and applying the treatment liquid to the printing medium so as to be in contact with the plurality of pigment-based inks applied to the printing medium, wherein in the step of applying the treatment liquid, the treatment liquid is applied to the printing medium in such a manner that a proportion of an applying amount of the treatment liquid to that of a pigment-based ink relatively small in contact angle with respect to the treatment liquid is made smaller than a proportion of an applying amount of the treatment liquid to that of a pigment-based ink relatively great in contact angle with respect to the treatment liquid.

According to another aspect of the present invention, a data generating apparatus for generating data for applying a treatment liquid for improving a performance of an image formed by a plurality of pigment-based inks, comprising: generation unit for generating data of applying the treatment liquid in contact with a pigment-based ink relatively small in contact angle with respect to the treatment liquid on the basis of data of applying the pigment-based ink relatively small in contact angle and also generating data of applying the treatment liquid in contact with a pigment-based ink relatively great in contact angle with respect to the treatment liquid on the basis of data of applying the pigment-based ink relatively great in contact angle, wherein the generation unit generates the data of applying the treatment liquid in such a manner that a proportion of the treatment liquid applied to a position to which the pigment-based ink relatively small in contact angle are applied is made smaller than a proportion of the treatment liquid applied to a position to which the pigment-based ink relatively great in contact angle are applied.

According to another aspect of the present invention, a storage medium which stores computer programs for allowing a computer to execute generation processing for generating data of applying a treatment liquid for improving a performance of an image formed by a plurality of pigment-based inks, wherein the generation processing includes a step of generating the data of applying the treatment liquid on the basis of the data of applying a pigment-based ink relatively small in contact angle with respect to the treatment liquid and the data of applying a pigment-based ink relatively great in contact angle with respect to the treatment liquid in such a manner that a proportion of the treatment liquid applied to a position to which the pigment-based ink relatively small in contact angle are applied is made smaller than a proportion of the treatment liquid applied to a position to which the pigment-based ink relatively great in contact angle are applied.

According to another aspect of the present invention, an inkjet printing system including an inkjet printing apparatus for printing an image by applying a plurality of pigment-based inks and a treatment liquid for improving a performance of the image formed by the plurality of pigment-based inks to a printing medium, and a data supplying apparatus for supplying data to the inkjet printing apparatus, wherein the data supplying apparatus is provided with generation unit for generating data of applying the treatment liquid on the basis of data of applying a pigment-based ink relatively small in contact angle with respect to the treatment liquid and data of applying a pigment-based ink relatively great in contact angle with respect to the treatment liquid in such a manner that a proportion of the treatment liquid applied to a position to which the pigment-based ink relatively small in contact angle are applied is made smaller than a proportion of the treatment liquid applied to a position to which the pigment-based ink relatively great in contact angle are applied, and supply unit for supplying to the inkjet printing apparatus the data of applying the treatment liquid generated by the generation unit, and wherein the inkjet printing apparatus is provided with a treatment liquid applying unit capable of applying the treatment liquid to the printing medium on the basis of the data of applying the treatment liquid supplied from the supply unit.

According to the present invention, such processing is conducted that a proportion of an amount of applying a treatment liquid to that of applying pigment-based inks is changed, depending on a difference in contact angle between the pigment-based inks and the treatment liquid. More specifically, a proportion of an amount of applying the treatment liquid to that of applying inks relatively small in contact angle (ink excellent in wettability) is made smaller than a proportion of an amount of applying the treatment liquid to that of applying inks relatively great in contact angle (ink poor in wettability). Thereby, it is possible to improve image performance, while reducing an amount of the treatment liquid consumed.

Further features of the present invention will become apparent from the following description of exemplary embodiments (with reference to the attached drawings).

BRIEF DESCRIPTION OF THE DRAWINGS

FIG. 6 is a table showing values of contact angles of black ink and light cyan ink;

FIG. 9 is a table showing assessment results of scratch resistance;

FIG. 10 is a table showing an optimal use amount of the treatment liquid, depending on a difference in wettability;

DESCRIPTION OF THE EMBODIMENTS

In the present specification, the "treatment liquid" is a liquid (image-performance improving liquid) for improving the image performance such as fastness of a printed image and image quality on contact with inks. In this instance, "improvement in fastness of a printed image" means to improve the fastness of an ink image by improving at least any one of scratch resistance, weatherability, water resistance, and alkali resistance. On the other hand, "improvement in image quality" means to improve the quality of an ink image by improving at least any one of gloss, haze, and bronzing.

In this instance, "scratch resistance" is such that evaluation is made by minimum load value measured according to a method specified in JIS K5600-5-5. And, "improvement in scratch resistance" means to increase a value of minimum load value.

Further, "weatherability" is such that evaluation is made by a degree of a change (grade) measured according to a method specified in JIS K5600-7-6. For example, the degree of the change of the color is evaluated by using the color difference.

And, "improvement in weatherability" means to decrease a value of a degree of a change (grade).

Further, "water resistance" is such that evaluation is made by an observation of a sign of a damage measured according to a method specified in JIS K5600-6-1. And, "improvement in water resistance" means to decrease a value of an observation of a sign of a damage.

Further, "alkali resistance" is such that evaluation is made by an observation of a sign of a damage measured according to a method specified in JIS K5600-6-1. And, "improvement in alkali resistance" means to decrease a value of an observation of a sign of a damage.

Further, "gloss" is such that evaluation is made by gloss value measured according to a method specified in JIS K5600-4-7. And, "improvement in gloss" means to increase a value of gloss value.

Further, "haze" is such that evaluation is made by a haze value measured according to a method specified in JIS K7374. And, "improvement in haze" means to decrease a value of a haze value.

Still further, "bronzing" is such that evaluation is made by a chromaticity measured according to a method specified in JIS K0115. And, "improvement in bronzing" means to get closer to achromatic color a value of a chromaticity.

Overall Constitution

Hereinafter, a description will be given of one embodiment of the present invention with reference to the drawings.

Figure 1:
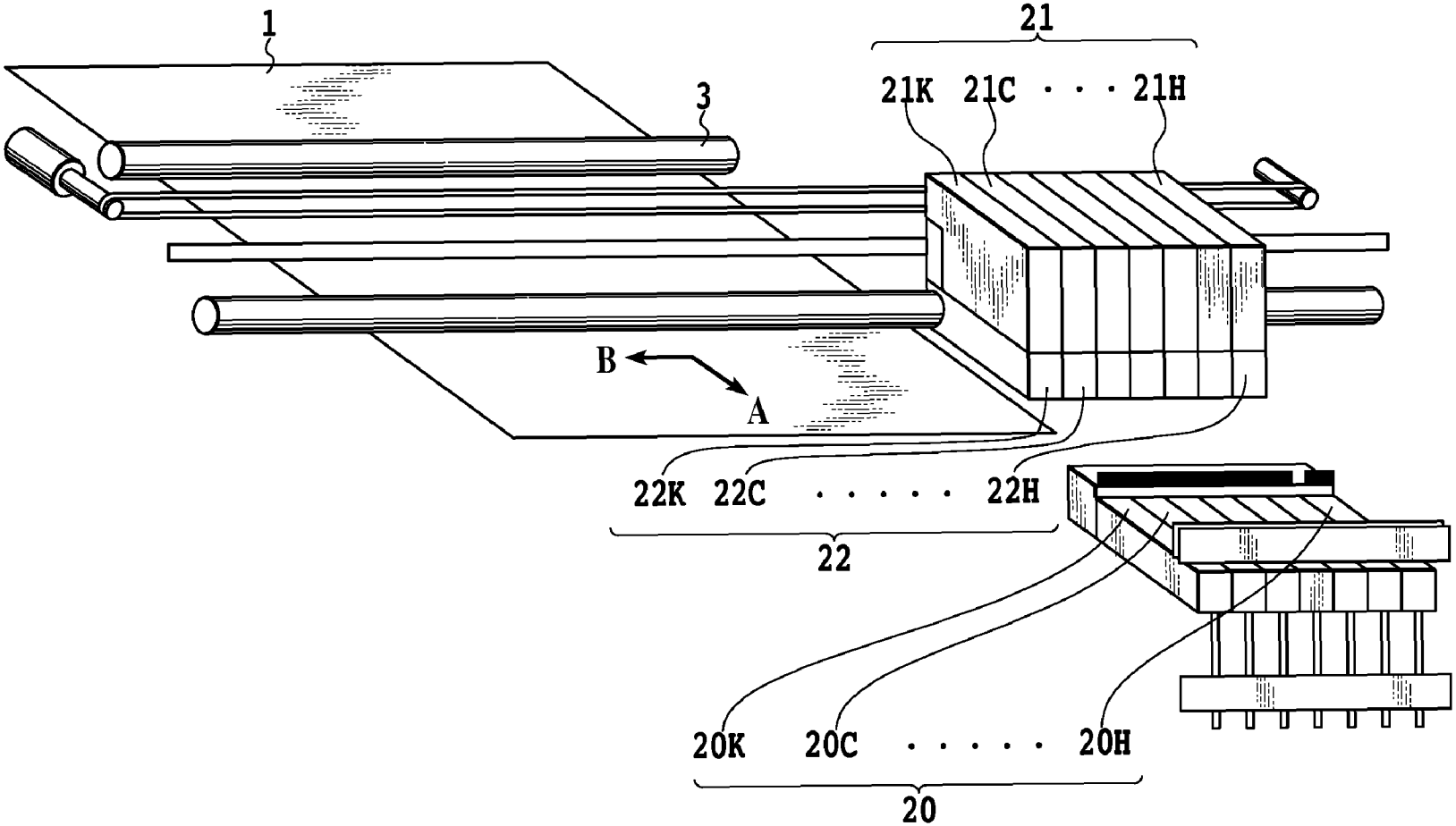
FIG. 1 is a perspective view showing major parts of an inkjet printing apparatus of the present embodiment.

An overall constitution of an inkjet printing apparatus of the present embodiment will be described. FIG. 1 is a perspective view showing major parts of the inkjet printing apparatus of the present embodiment. A print head 22 is constituted with print heads for color pigment-based inks and a print head for a treatment liquid, and the color pigment-based inks and the treatment liquid are ejected to a printing medium 1 from ejection ports installed on these print heads, thereby performing printing.

The print head 22 is constituted with seven print heads, 22K, 22C, 22M, 22Y, 22LC, 22LM and 22H for respectively ejecting color pigment-based inks of black (K), cyan (C), magenta (M), yellow (Y), light cyan (LC) and light magenta (LM) as well as a treatment liquid (H). Further, an ink tank 21 is constituted with seven ink tanks 21K, 21C, 21M, 21Y, 21LC, 21LM, and 21H for storing inks of corresponding colors and the treatment liquid supplied respectively to the print heads 22K, 22C, 22M, 22Y, 22LC, 22LM and 22H. These print heads 22 and the ink tanks 21 are able to move to a main scanning direction (a direction given by the arrow B).

A cap 20 is constituted with seven caps 20K, 20C, 20M, 20Y, 20LC, 20LM and 20H for capping respective ink ejection faces of seven print heads. The print heads 22 and the ink tanks 21 return to a home position at which the cap 20 is provided and are on standby when no printing is performed.

It is noted that where these print heads and ink tanks are individually referred to, respective given reference numbers are used and where they are comprehensively referred to, "22," "21" and "20" are used respectively for the print head, the ink tank and the cap as collective reference numbers.

Further, the print head and the ink tank used in this instance may be that in which the print head is constituted integrally with the ink tank or they may be constituted separately.

Figure 2:
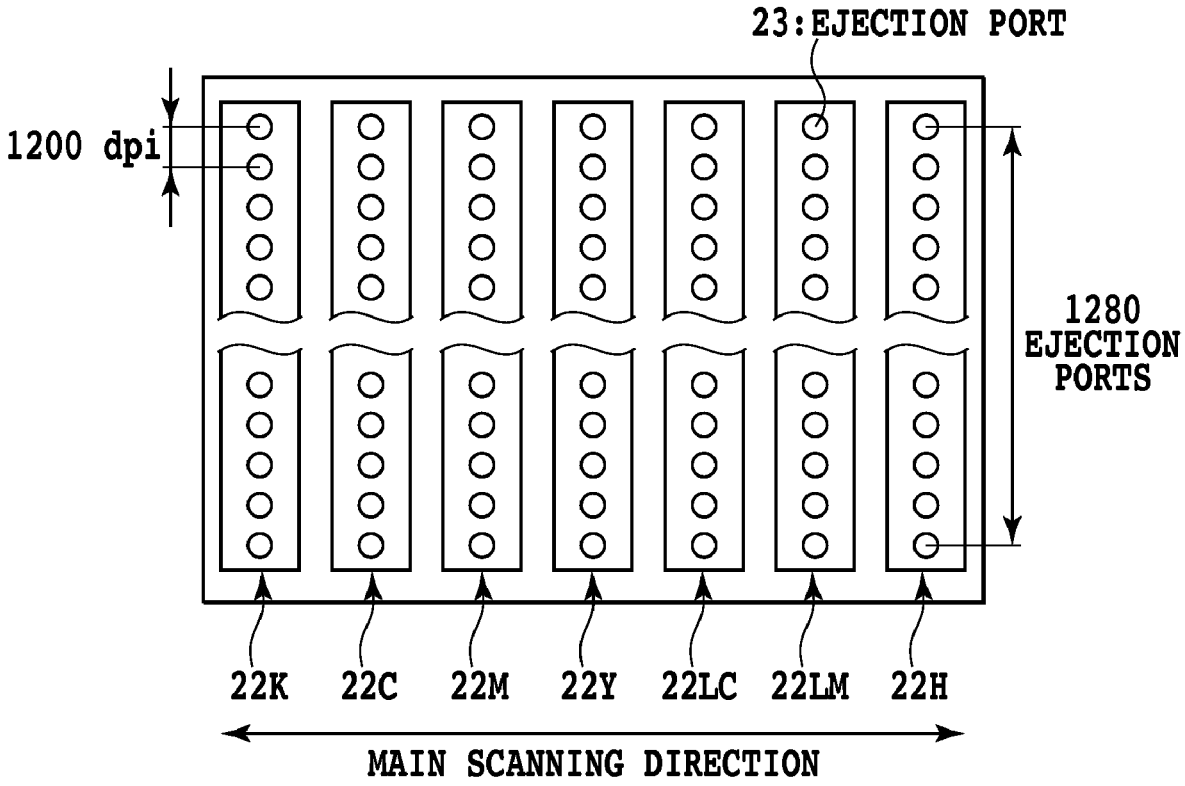
FIG. 2 is a drawing of a print head when viewed from ejection ports.

FIG. 2 is a drawing of the print head 22 when viewed from the ejection ports. The print head is provided with 1280 ejection ports arrayed in a direction intersecting with the main scanning direction, thereby forming ejection port arrays of the respective colors.

Figure 3:
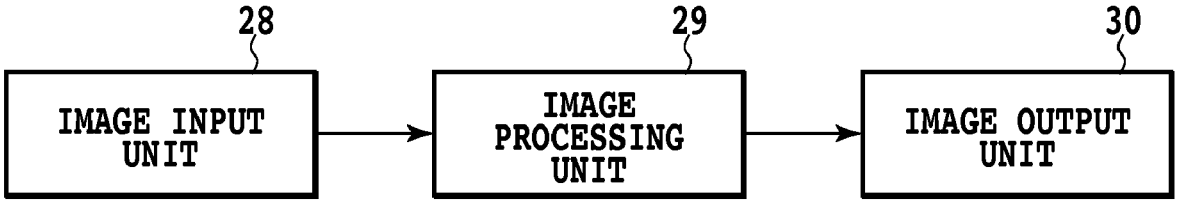
FIG. 3 is a view showing a brief constitution of the inkjet printing apparatus of a representative embodiment of the present invention.

FIG. 3 is a block diagram showing a brief constitution of an inject apparatus which is a representative embodiment of the present invention. An image input unit 28 is to input multi-valued image data from image input devices such as a scanner and a digital camera and multi-valued image data stored in various types of printing media such as a hard disk. An image processing unit 29 gives image processing to be described later to multi-valued image data input by the image input unit 28, thereby converting the data to binary image data.

Thereby, generated is binary image data (pigment-based ink applying data) for applying a plurality of pigment-based inks. Further, also generated here is binary image data (treatment liquid applying data) for applying the treatment liquid. An image output unit 30 applies pigment-based inks and the treatment liquid on the basis of binary image data converted by the image processing unit 29 covering at least two or more types of pigment-based inks and the treatment liquid, thereby forming an image. In addition, although not illustrated, each unit constituting the printing apparatus is provided with a CPU for controlling operations of each own unit and cooperative operations with other units, a ROM for storing control programs of the CPU and a RAM used as a working area to execute the control programs.

A description will be given of printing operations of the above-constituted printing apparatus with reference to FIG. 1 and FIG. 2. A plurality of sheets of glossy paper (printing paper 1) stacked on a cassette (not illustrated) are fed one by one by a feeding roller (not illustrated) to a printing operation area. Then, glossy paper 1 is conveyed by a pair of conveying rollers 3 between the print head 22 and a platen (not illustrated) at the printing operation area. On the other hand, inks and the treatment liquid are supplied from the ink tanks 21 to the print head 22, and the print head 22 performs printing on the glossy paper according to binary image data, while moving in a direction given by the arrow B in FIG. 1 (outward scanning direction).

This printing is performed by applying ink droplets to the glossy paper in the order of black, cyan, magenta, yellow, light cyan, light magenta and treatment liquid. Then, on completion of the printing for one scan, in a case of unidirectional printing, the print head 22 returns to an original home position, and again performs printing in the order of black, cyan, magenta, yellow, light cyan, light magenta, and treatment liquid in a direction given by the arrow −B (outward scanning direction). On the other hand, in a case of bidirectional printing, while the print head moves in a direction toward the home position given by the arrow B (homeward scanning direction), it performs printing in the order of treatment liquid, light magenta, light cyan, yellow, magenta, cyan, and black. Prior to the start of next printing operation after completion of one-time unidirectional printing operation (one scan), a pair of conveying rollers 3 are driven to convey intermittently in a predetermined amount of the glossy paper to a direction given by the arrow A.

Figure 4A:
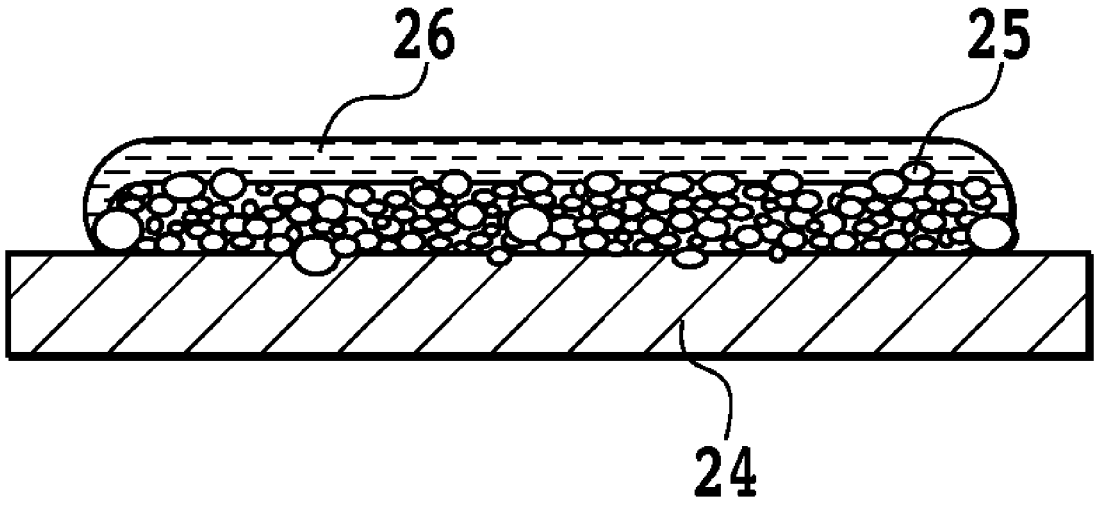
FIG. 4A is a schematic diagram illustrating the cross section of a printed image on which a treatment liquid is used to form a transparent layer.
Figure 4B:
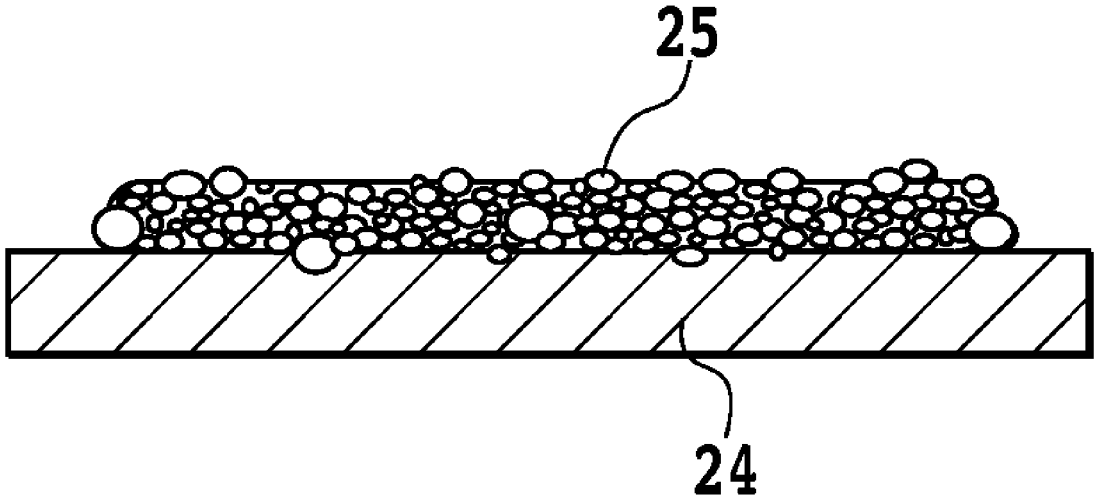
FIG. 4B is a schematic diagram illustrating the cross section of a printed image obtained when pigment-based inks are used to print an image on a printing medium having an ink receiving layer.

As described so far, printing operation of one scan and a predetermined amount of conveying operation are repeated, by which printing is performed on the glossy paper at every predetermined width. Therefore, in the present embodiment, it is possible to execute a unidirectional printing mode in which the treatment liquid is overlaid on the pigment-based inks constantly in a fixed order as well as a bidirectional printing mode in which an order of applying the pigment-based inks and the treatment liquid is reversed on every scan. The effect to be described later can be obtained both in these printing modes.

Where pigment-based inks are used to form an image on glossy paper, as shown in FIG. 4B described above, color pigment particles are not allowed to enter into an ink receiving layer, thereby a pigment-based ink layer 25 is formed on the surface of the ink receiving layer. Therefore, since an external force directly acts on the pigment-based ink layer 25, the surface of the image is likely to be damaged and the pigment-based ink layer 25 is also likely to be peeled. In an actual use environment, in the course of handling during which a printing medium is rolled or affixed to a wall, an image is severely damaged "on contact with a fingernail," and there is even found such a case that the pigment-based ink layer is completely peeled off.

On the other hand, as shown in FIG. 4A, where a transparent layer 26 of the treatment liquid is formed so as to coat the uppermost surface of the pigment-based ink layer 25, there is no chance that the pigment-based ink layer is directly in contact with a fingernail or the like. It is, therefore, possible to prevent the pigment-based ink layer from being peeled. As described above, a direct protection of the pigment-based ink layer is quite effective in improving the scratch resistance. In order to improve the scratch resistance of the pigment-based ink layer 25, the treatment liquid may be mixed with the pigment-based inks.

Therefore, such an embodiment is acceptable that the treatment liquid is applied before the pigment-based inks are applied, by which the pigment-based inks are mixed with the treatment liquid, thereby the pigment-based ink layer in itself is made stronger to provide the effect of scratch resistance. In other words, the effect of scratch resistance can be obtained not only by a unidirectional printing in which the treatment liquid is overlaid on the pigment-based inks but also by a bidirectional printing in which a part at which the treatment liquid is overlaid on the pigment-based inks and a part at which the pigment-based inks are overlaid on the treatment liquid coexist. As described so far, in the present invention, there is no limitation to an order of applying the pigment-based inks and the treatment liquid. The pigment-based inks may be brought into contact with the treatment liquid, thereby improving image performance such as image quality and fastness of a printed image.

Composition of Inks and Treatment Liquid

Next, a description will be given of a composition of pigment-based inks and a treatment liquid used in the present embodiment. As will be described later, black, magenta and yellow inks are relatively great in contact angle with respect to the treatment liquid, while cyan, light cyan and light magenta inks are relatively small in contact angle with respect to the treatment liquid. Hereinafter, "part" and "%" are by mass, unless otherwise specified.

Yellow Ink (1) Preparation of Dispersion Liquid

A pigment [C.I. pigment yellow 74 (product name: Hansa Brilliant Yellow 5GX (made by Clariant (Japan) K.K.))] 10 parts, an anionic polymer P-1 [styrene/butylacrylate/acrylic acid copolymer (copolymerization ratio (weight ratio)=30/40/30), acid value 202, weight average molecular weight 6500, an aqueous solution with solid content of 10%, a neutralizer: potassium hydroxide] 30 parts, and pure water 60 parts were mixed. The materials given below were fed into a batch-type vertical sand mill (made by IMEX Co., Ltd.) and 0.3 mm-across zirconia beads, 150 parts, were loaded thereinto. The resultant was subjected to dispersion for 12 hours, while being cooled. Further, the thus obtained dispersion liquid was centrifuged to remove coarse particles. Then, as a final preparation, obtained was a pigment dispersion 1 with a solid content of about 12.5% and weight average particle size of 120 nm. The pigment dispersion was used to prepare inks as follows.

(2) Preparation of Ink

The ingredients given below were mixed, sufficiently agitated, dissolved, dispersed, and, then, filtered through a micro filter (made by FUJIFILM Corporation) with a pore size of 1.0 μm under pressure to prepare inks.

Above-obtained pigment dispersion: 40 parts
Glycerin: 9 parts
Ethylene glycol: 6 parts
Acetylene glycol ethylene oxide addition product (product name: Acethylenol EH): 1 part
1,2-hexanediol: 3 parts
Polyethylene glycol (molecular weight 1000): 4 parts
Water: 37 parts Magenta Ink (1) Preparation of Dispersion Liquid First, benzyl acrylate and methacrylic acid were used as starting materials to prepare an AB-type block polymer (acid value 300, number average molecular weight 2500) according to an ordinary method, and the polymer was neutralized with potassium hydroxide aqueous solution and diluted with ion-exchanged water to prepare a homogenous polymer aqueous solution (50% by mass).

The above polymer solution, 100 g, C.I. pigment red 122, 100 g, and ion-exchanged water, 300 g, were mixed and agitated mechanically for 0.5 hours.

Next, the mixture was treated by using a microfluidizer by allowing it to pass five times through an interaction chamber under a liquid pressure of about 70 MPa.

Further, the thus obtained dispersion liquid was subjected to centrifugation (12,000 rpm, 20 minutes) to remove non-dispersed materials including coarse particles, thereby obtaining a magenta dispersion liquid. The thus obtained magenta dispersion liquid was 10% by mass in pigment concentration and 5% by mass in dispersant concentration.

(2) Preparation of Ink

The ink was prepared by procedures in which the above magenta dispersion liquid was used, the ingredients given below were added thereto to give a predetermined concentration, the thus prepared ingredients were sufficiently mixed and agitated and, then, filtered under pressure through a micro filter (made by FUJIFILM Corporation) with a pore size of 2.5 μm. The thus prepared pigment-based ink was 4% by mass in pigment concentration and 2% by mass in dispersant concentration.

Above magenta dispersion liquid: 40 parts
Glycerin: 10 parts
Diethylene glycol: 10 parts
Acetylene glycol EO addition product: 0.5 parts
Ion-exchanged water (made by Kawaken Fine Chemicals Co., Ltd.): 39.5 parts Light Magenta Ink (1) Preparation of Dispersion Liquid The polymer solution used in preparing the magenta ink, 100 g, a C.I. pigment red 122, 100 g and ion-exchanged water, 300 g, were mixed and mechanically agitated for 0.5 hours.

Next, the mixture was treated by using a microfluidizer by allowing it to pass five times through an interaction chamber under a liquid pressure of about 70 MPa.

Further, the thus obtained dispersion liquid was subjected to centrifugation (12,000 rpm, 20 minutes) to remove non-dispersed materials including coarse particles, thereby obtaining a magenta dispersion liquid. The thus obtained magenta dispersion liquid was 10% by mass in pigment concentration and 5% by mass in dispersant concentration.

(2) Preparation of Ink

The ink was prepared by procedures in which the above magenta dispersion liquid was used, the ingredients given below were added thereto to give a predetermined concentration, the thus prepared ingredients were sufficiently mixed and agitated and, then, filtered under pressure through a micro filter (made by FUJIFILM Corporation) with a pore size of 2.5 μm. The thus prepared pigment-based ink was 4% by mass in pigment concentration and 2% by mass in dispersant concentration.

Above magenta dispersion liquid: 8 parts
Glycerin: 10 parts
Diethylene glycol: 10 parts
Acetylene glycol EO addition product: 0.5 parts
Ion-exchanged water (made by Kawaken Fine Chemicals Co., Ltd.): 71.5 parts Cyan Ink (1) Preparation of Dispersion Liquid First, benzyl acrylate and methacrylic acid were used as starting materials to prepare an AB-type block polymer (acid value 250, number average molecular weight 3000) according to an ordinary method, and the polymer was neutralized with potassium hydroxide aqueous solution and diluted with ion-exchanged water to prepare a homogenous polymer aqueous solution (50% by mass).

The above polymer solution, 180 g, C.I. pigment blue 15:3, 100 g, and ion-exchanged water, 220 g, were mixed and agitated mechanically for 0.5 hours.

Next, the mixture was treated by using a microfluidizer by allowing it to pass five times through an interaction chamber under a liquid pressure of about 70 MPa.

Further, the thus obtained dispersion liquid was subjected to centrifugation (12,000 rpm, 20 minutes) to remove non-dispersed materials including coarse particles, thereby obtaining a cyan dispersion liquid. The thus obtained cyan dispersion liquid was 10% by mass in pigment concentration and 10% by mass in dispersant concentration.

(2) Preparation of Ink

The ink was prepared by procedures in which the above cyan dispersion liquid was used, the ingredients given below were added thereto to give a predetermined concentration, the thus prepared ingredients were sufficiently mixed and agitated and, then, filtered under pressure through a micro filter (made by FUJIFILM Corporation) with a pore size of 2.5 μm. The thus prepared pigment-based ink was 2% by mass in pigment concentration and 2% by mass in dispersant concentration.

Above cyan dispersion liquid: 20 parts
Glycerin: 10 parts
Diethylene glycol: 10 parts
Acetylene glycol EO addition product: 0.5 parts
Ion-exchanged water (made by Kawaken Fine Chemicals Co., Ltd.): 59.5 parts Light Cyan Ink (1) Preparation of Dispersion Liquid The polymer solution used in preparing the cyan ink, 180 g, a C.I. pigment blue 15:3, 100 g, and ion-exchanged water, 220 g, were mixed and mechanically agitated for 0.5 hours.

Next, the mixture was treated by using a microfluidizer by allowing it to pass five times through an interaction chamber under a liquid pressure of about 70 MPa.

Further, the thus obtained dispersion liquid was subjected to centrifugation (12,000 rpm, 20 minutes) to remove non-dispersed materials including coarse particles, thereby obtaining a cyan dispersion liquid. The thus obtained cyan dispersion liquid was 10% by mass in pigment concentration and 10% by mass in dispersant concentration.

(2) Preparation of Ink

The ink was prepared by procedures in which the above cyan dispersion liquid was used, the ingredients given below were added thereto to give a predetermined concentration, the thus prepared ingredients were sufficiently mixed and agitated and, then, filtered under pressure through a micro filter (made by FUJIFILM Corporation) with a pore size of 2.5 μm. The thus prepared pigment-based ink was 2% by mass in pigment concentration and 2% by mass in dispersant concentration.

Above cyan dispersion liquid: 4 parts
Glycerin: 10 parts
Diethylene glycol: 10 parts
Acetylene glycol EO addition product: 0.5 parts
Ion-exchanged water (made by Kawaken Fine Chemicals Co., Ltd.): 75.5 parts Black Ink (1) Preparation of Dispersion Liquid The polymer solution used in preparing the yellow ink, 100 g, carbon black, 100 g, and ion-exchanged water, 300 g, were mixed and mechanically agitated for 0.5 hours.

Next, the mixture was treated by using a microfluidizer by allowing it to pass five times through an interaction chamber under a liquid pressure of about 70 MPa.

Further, the thus obtained dispersion liquid was subjected to centrifugation (12,000 rpm, 20 minutes) to remove non-dispersed materials including coarse particles, thereby obtaining a black dispersion liquid. The thus obtained black dispersion liquid was 10% by mass in pigment concentration and 6% by mass in dispersant concentration.

(2) Preparation of Ink

The ink was prepared by procedures in which the above black dispersion liquid was used, the ingredients given below were added thereto to give a predetermined concentration, the thus prepared ingredients were sufficiently mixed and agitated and, then, filtered under pressure through a micro filter (made by FUJIFILM Corporation) with a pore size of 2.5 μm. The thus prepared pigment-based ink was 5% by mass in pigment concentration and 3% by mass in dispersant concentration.

Above black dispersion liquid: 50 parts
Glycerin: 10 parts
Triethylene glycol: 10 parts
Acetylene glycol EO addition product: 0.5 parts
Ion-exchanged water (made by Kawaken Fine Chemicals Co., Ltd.): 29.5 parts Treatment Liquid (1) Preparation of Treatment Liquid The ingredients given below were mixed and sufficiently agitated to prepare a treatment liquid.

Commercially available acryl silicone copolymer (product name: SYMAC US-450; made by Toagosei Co., Ltd.): 5 parts
Glycerin: 5 parts
Ethylene glycol: 15 parts
Acetylene glycol ethylene oxide addition product (product name: Acethylenol EH): 0.5 parts
Water: 74.5 parts It is important that the treatment liquid contains a transparent resin material for improving the scratch resistance of a printed image. As one example of the transparent resin materials, included is a transparent resin material obtained by copolymerization with a polydimethylsiloxane ingredient. The use of the above-described transparent resin material will yield slip properties, thus making it possible to efficiently reduce a coefficient of dynamic friction. In the present embodiment, used is a transparent resin material obtained by copolymerization of a commercially available polydimethylsiloxane ingredient (the above-described acryl silicone copolymer: SYMAC US-450).

A general polydimethylsiloxane compound has a polydimethylsiloxane segment expressed by the following structural formula (1). The polydimethylsiloxane ingredient has the arrangement of a methyl group (—CH3) around siloxane binding chains of (Si—O—Si), thereby having a molecular structure low in polarity. Therefore, since the surface of a material lower in surface energy is more stable, it is considered that the polydimethylsiloxane ingredient will localize on the surface of a transparent resin layer.

[Structural formula (1)]

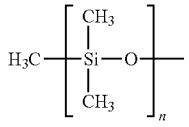

Polydimethylsiloxane compounds are mostly found in a liquid form but varied in flowability from those which flow freely like water to those which are glutinous like starch syrup, depending on the number of repeating units of (Si—O—Si). It is considered in general that a substance is more stable when it is lower in surface energy. Thus, polydimethylsiloxane compounds having the flowability will move to the surface or the interface of a substance and localize in the vicinity thereof. As a result, there is found a decrease in surface energy of a coat layer, thereby reducing friction between the coat layer and balls of polymethyl methacrylate (PMMA). In other words, it may be possible to attain an outstanding reduction in coefficient of dynamic friction.

As a transparent resin material having slip properties, also found is that in which silicone oil is added to an acrylic resin. Any materials may be used as long as they are able to form a transparent resin layer on the uppermost surface of a pigment-based ink layer, thereby reducing a coefficient of dynamic friction.

Characteristic Constitution

In the present embodiment, a treatment liquid is applied optimally, with attention given to a difference in contact angle (wettability) of pigment-based inks with respect to the treatment liquid. Hereinafter, a description will be given of the contact angle (wettability).

Figure 5A:
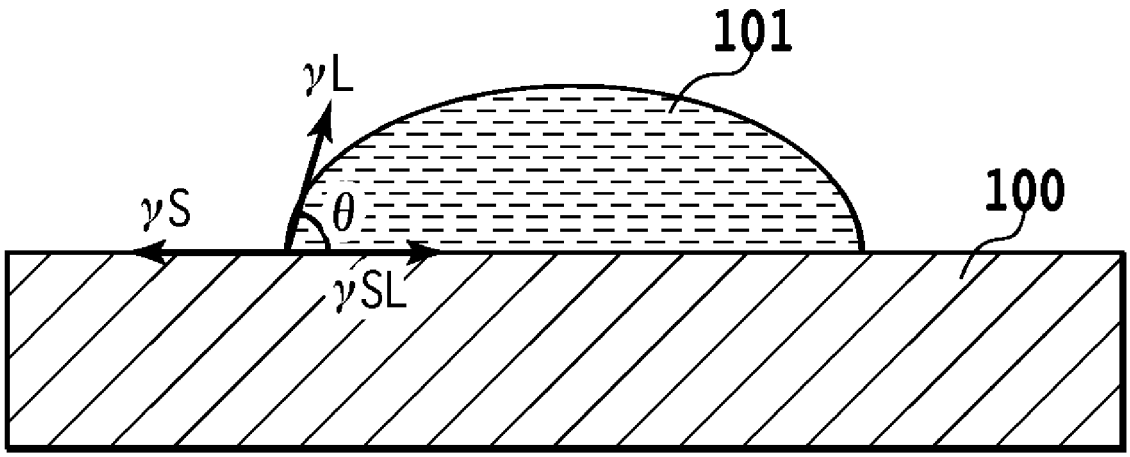
FIG. 5A is a view for explaining a method for measuring a contact angle of the droplets on a solid surface.
Figure 5B:
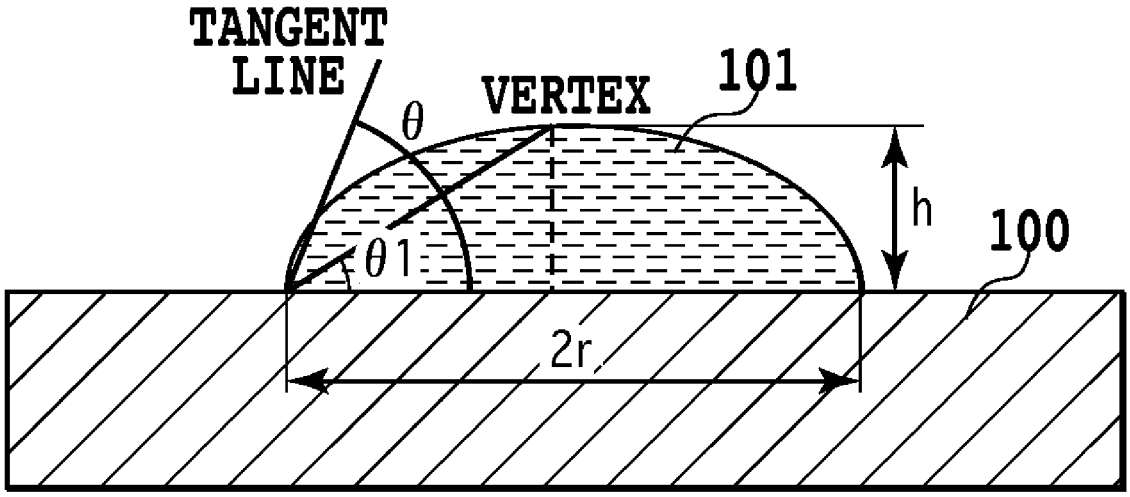
FIG. 5B is a view for explaining a method for measuring a contact angle of the droplets on the solid surface.

FIG. 5A and FIG. 5B are drawings for explaining a method for measuring a contact angle of droplets on a solid surface. In general, as shown in FIG. 5A, when droplets 101 are placed on the solid surface 100 to attain equilibrium in a certain state, the following formula is obtained.

$$\gamma S: \gamma L \cos\theta + \gamma SL \quad \text{(formula 1)}$$

γS: solid surface tension
γSL: solid-liquid interface tension
γL: liquid surface tension The formula 1 is referred to as "Young's equation." In this instance, an angle formed by the liquid surface and the solid surface is the "contact angle." It is generally considered that the smaller, the contact angle, "the better, the wettability," and the greater, the contact angle, "the poorer, the wettability."

In general, the "θ/2 method" is used as a method for measuring the contact angle. The "θ/2 method" is, as shown in FIG. 5B, a method by which a contact angle θ is determined from an angle θ1 of a line connecting the lateral end points of a droplet with the vertex with respect to the solid surface. The following formula is met by referring to a geometric theorem on the assumption that a shape of the droplet is taken as a part of the circle.

$$2\theta 1=\theta \quad \text{(formula 2)}$$

However, as described previously, the "θ/2 method" is based on the assumption that a droplet is a part of the sphere and will have an error on measurement of a crushed droplet due to the influence of gravity. Therefore, there is a case where a tangent method or a curve fitting method is used to make analysis. A detailed description of the tangent method or the curve fitting method will be omitted here.

In the present specification, the "contact angle" of ink is defined as follows. Specifically, the surface of an image formed by a pigment-based ink is assumed to be a solid surface 100 and a droplet made by dropping (ejecting) a treatment liquid is given as a droplet 101. Then, an angle □ formed by the droplet 101 and a part in contact with the pigment-based ink is measured and given as a contact angle of the pigment-based ink with respect to the treatment liquid. The measurement was made by using DropMaster made by Kyowa Interface Science Co., Ltd. It is noted that there is no limitation to a measuring instrument as long as it is able to measure a contact angle formed by the pigment-based ink and the treatment liquid.

Next, a description will be given of the effectiveness in changing an amount of applying the treatment liquid depending on a difference in contact angle (wettability) by exemplifying the black ink and the light cyan ink exhibiting a great difference in contact angle when measured by the above measuring instrument among the pigment-based inks of the present embodiment.

FIG. 6 is a table showing values of the respective contact angles formed by the black ink and the light cyan ink with respect to the treatment liquid. Among the pigment-based inks used in the present embodiment, the black ink which exhibited the greatest value of the contact angle was 35 degrees in contact angle, while the light cyan ink which exhibited the smallest value of the contact angle was 12 degrees in contact angle.

Figure 7A:
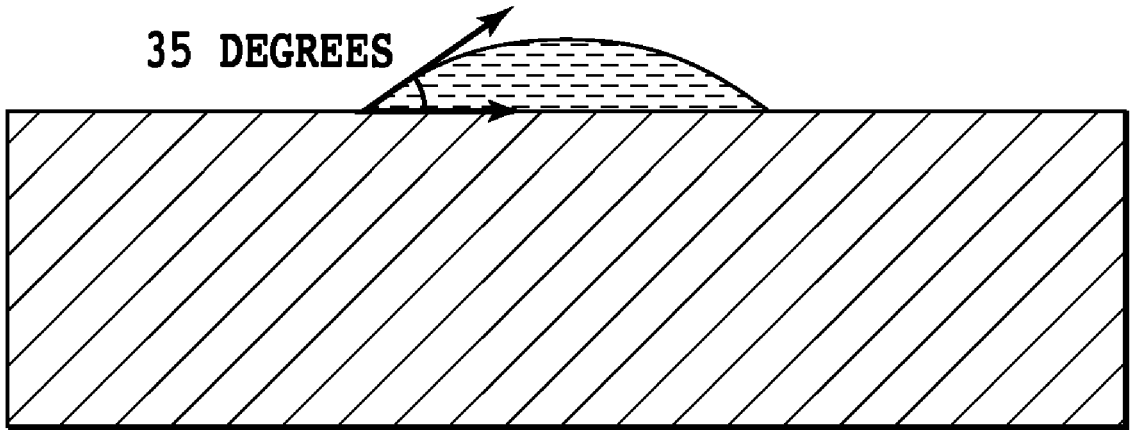
FIG. 7A is a view for explaining a difference in contact angle of the treatment liquid where the treatment liquid is dropped on pigment-based inks different in contact angle.
Figure 7B:
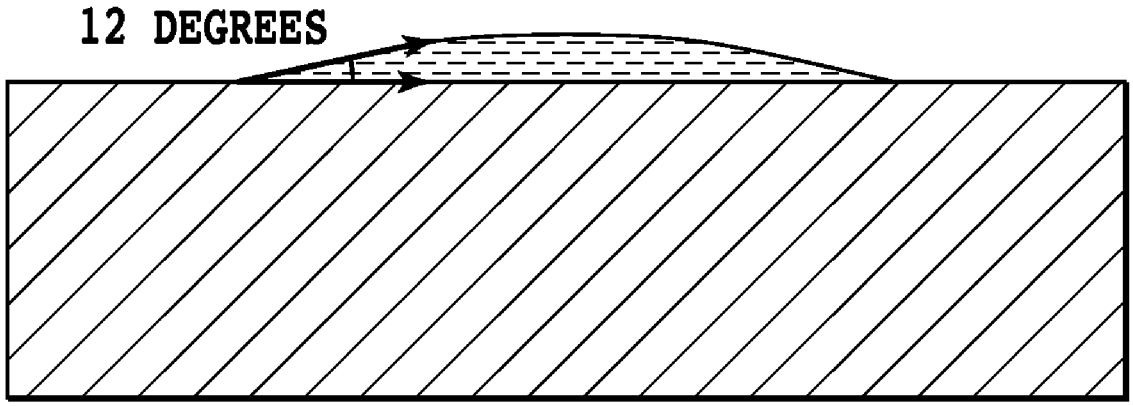
FIG. 7B is a view for explaining a difference in contact angle of the treatment liquid where the treatment liquid is dropped on pigment-based inks different in contact angle.

FIG. 7A and FIG. 7B are drawings for explaining a difference in contact angle of the treatment liquid in a case where the treatment liquid is dropped on pigment-based inks different in contact angle according to the above definition. FIG. 7A shows a state that the treatment liquid is dropped on the black ink, and FIG. 7B shows a state that the treatment liquid is dropped on the light cyan ink. Values of the contact angles are deeply related to a dot spread area of the treatment liquid when the treatment liquid is in contact with the pigment-based inks. Specifically, the smaller, the value of the contact angle of a pigment-based ink (the better, the wettability), the larger, the spread area of the treatment liquid on the pigment-based ink. The larger, the value of the contact angle of a pigment-based ink (the poorer, the wettability), the smaller, the spread area of the treatment liquid on the pigment-based ink.

The present embodiment is characterized in that a proportion of an amount of applying the treatment liquid to that of applying pigment-based inks is made different among the pigment-based inks different in contact angle with respect to the treatment liquid, with attention given to a difference in the extent of a spread of the treatment liquid due to a difference in contact angles of these pigment-based inks.

In other words, since the treatment liquid is less likely to spread on a pigment-based ink great in contact angle, there are a relatively great number of dots of the treatment liquid necessary for coating the pigment-based ink great in contact angle completely or in a certain proportion. On the other hand, since the treatment liquid is more likely to spread on a pigment-based ink small in contact angle, there are a relatively smaller number of dots of the treatment liquid necessary for coating the pigment-based ink small in contact angle completely or in a certain proportion. Conventionally, irrespective of whether a pigment-based ink was small in contact angle or not, a proportion of an amount of applying the treatment liquid to that of applying the pigment-based ink was made equal. Therefore, the treatment liquid was used in an amount more than necessary. Whereas, in the present embodiment, pigment-based inks small in contact angle are made smaller in proportion of an amount of applying the treatment liquid to that of applying pigment-based inks than pigment-based inks great in contact angle. Therefore, it is possible to suppress an amount of applying the treatment liquid to a minimum necessary extent.

Figure 8:
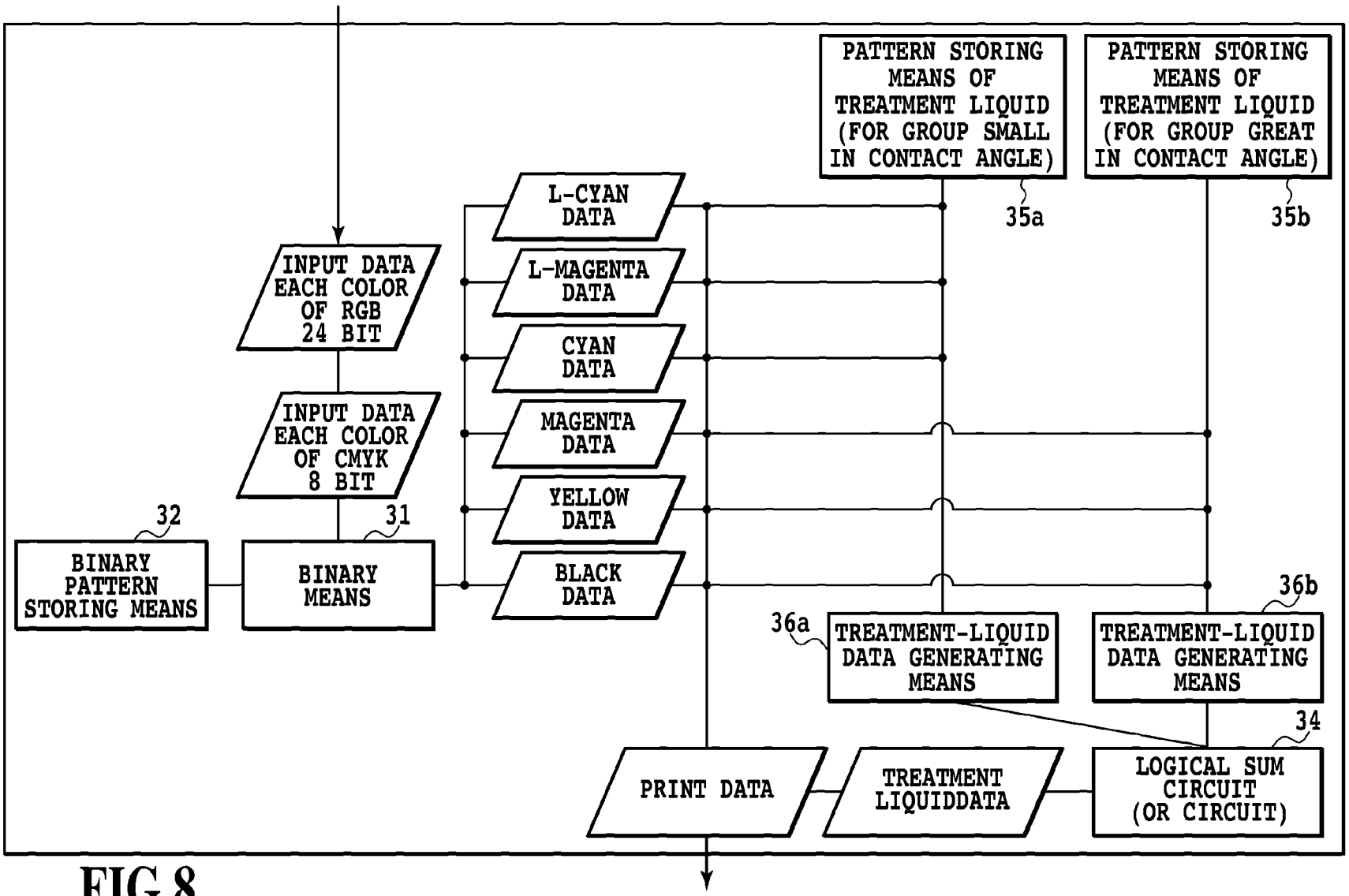
FIG. 8 is a block diagram showing an image processing unit given in FIG. 3.

Next, a description will be given of a controller capable of executing the above-described characteristic processing of the present embodiment with reference to FIG. 8. It is noted that the "characteristic processing" is processing for controlling an amount of applying the treatment liquid in such a manner that a proportion of an amount of applying the treatment liquid to that of applying pigment-based inks relatively smaller in contact angle is made smaller than a proportion of an amount of applying the treatment liquid to that of applying pigment-based inks relatively great in contact angle. FIG. 8 is a block diagram of the image processing unit 29 given in FIG. 3. The image processing unit 29 constitutes the controller capable of executing the above-described characteristic processing. An amount of applying the treatment liquid depending on wettability (contact angle) of pigment-based inks is decided by the image processing unit 29 which constitutes the controller.

Specifically, RGB-form multi-valued image data is first input from an image input unit 28. Then, the RGB-form multi-valued image data is converted to multi-valued image data individually corresponding to a plurality of inks (K, C, M, Y, LC and LM) used in forming an image. Then, the multi-valued image data corresponding to various types of inks is expanded to binary bitmap data of various types of inks by binarization device 31 according to patterns stored in binarization pattern storing unit 32. Thereby, generated is binary image data (pigment-based ink applying data) for individually applying a plurality of pigment-based inks.

Treatment liquid applying data for applying the treatment liquid is generated on the basis of the thus generated binary image data (pigment-based ink applying data) of a plurality of pigment-based inks. The treatment liquid applying data is generated by using treatment-liquid pattern storing unit 35*a*, 35*b*, treatment-liquid data generating unit 36*a*, 36*b* and logical sum operation processing device (OR circuit) 34.

Specifically, a plurality of pigment-based inks are in advance classified into a group small in contact angle and a group great in contact angle, depending on a difference in wettability (contact angle) with respect to a treatment liquid. In the present embodiment, light cyan (LC), light magenta (LM) and cyan (C) are classified into a group small in contact angle, while magenta (M), yellow (Y) and black (K) are classified into a group great in contact angle. Then, treatment-liquid applying patterns respectively corresponding to these groups are stored in the pattern storing unit 35*a*, 35*b*. As will be apparent from a description to be made later, the treatment-liquid applying pattern is a pattern for deciding a position (picture element) to which the treatment liquid is applied.

Figure 11A:
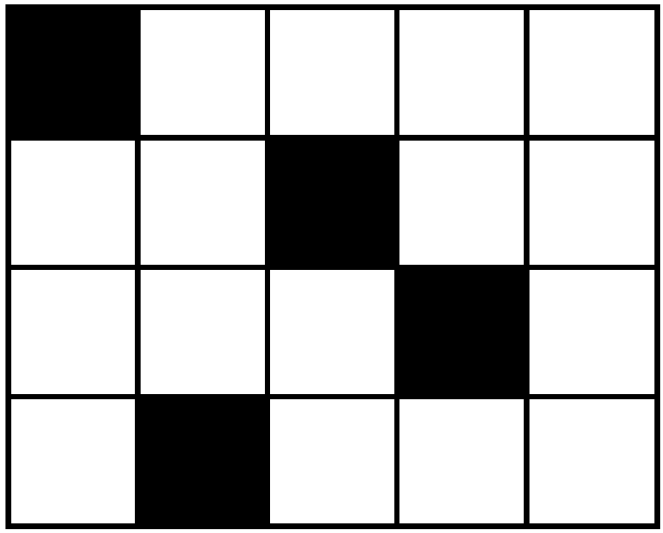
FIG. 11A is a view showing an applying pattern of the treatment liquid.
Figure 11B:
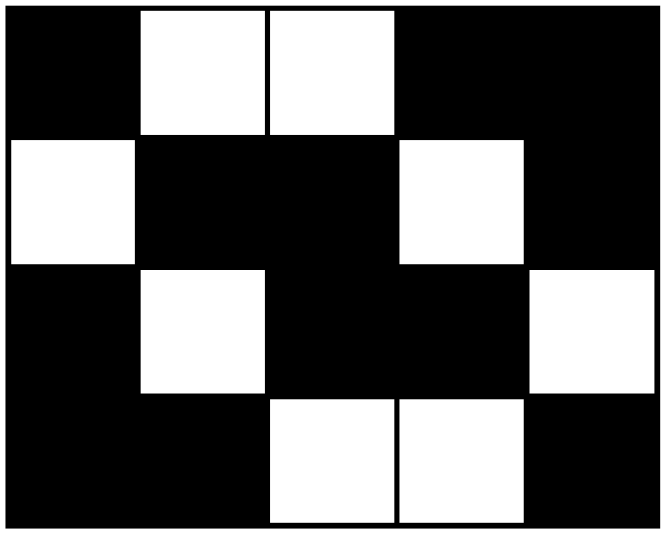
FIG. 11B is a view showing an applying pattern of the treatment liquid.

FIG. 11A and FIG. 11B are drawings for showing treatment-liquid applying patterns stored in the pattern storing unit 35*a*, 35*b*. FIG. 11A shows a treatment-liquid applying pattern to be stored in the pattern storing unit 35*a*, which is a pattern for thinning binary image data of pigment-based inks by performing AND processing with binary image data of pigment-based inks (LC, LM, C) relatively small in contact angle.

The treatment-liquid applying pattern is a pattern of 20% printing duty, thus making it possible to control the number of dots of the treatment liquid formed at a solid area of pigment-based inks giving a 100% printing duty to 20% of the number of dots of pigment-based inks which constitute the solid area.

On the other hand, FIG. 11B shows a treatment-liquid applying pattern to be stored in the pattern storing unit 35*b*, which is a pattern for thinning binary image data of pigment-based inks by performing AND processing with binary image data of pigment-based inks (M, Y, K) relatively great in contact angle.

The treatment-liquid applying pattern is a pattern of 60% printing duty, thus making it possible to control the number of dots of the treatment liquid formed at a solid area of pigment-based inks giving a 100% printing duty to 60% of the number of dots of pigment-based inks which constitute the solid area.

Binary bitmap data of the treatment liquid is generated in the treatment-liquid data generating unit 36*a*, 36*b* on the basis of treatment-liquid applying patterns stored in the pattern storing unit 35*a*, 35*b* and the binary image data of pigment-based inks. Specifically, first treatment liquid applying data is generated in the treatment-liquid data generating unit 36*a* by subjecting binary image data of pigment-based inks belonging to a group small in contact angle and data showing the treatment-liquid applying pattern given in FIG. 11A to AND processing (logical product operation). The first treatment liquid applying data is binary bitmap data for applying the treatment liquid to pigment-based inks belonging to a group small in contact angle. On the other hand, second treatment liquid applying data is generated in the treatment-liquid data generating unit 36*b* by subjecting binary image data of pigment-based inks belonging to a group great in contact angle and data showing the treatment-liquid applying pattern given in FIG. 11B to AND processing (logical product operation). The second treatment liquid applying data is bitmap data for applying the treatment liquid to pigment-based inks belonging to a group great in contact angle.

As described so far, the first treatment liquid applying data and the second treatment liquid applying data respectively generated in the treatment-liquid data generating unit 36*a*, 36*b* are input into the logical sum operation processing device (OR circuit) 34. Then, the first treatment liquid applying data and the second treatment liquid applying data are subjected to OR processing in the logical sum operation processing device (OR circuit) 34. Thereby, treatment liquid applying data (binary bitmap data of the treatment liquid) is generated for applying the treatment liquid to pigment-based inks belonging to both a group great in contact angle and a group small in contact angle. Then, the treatment liquid applying data is sent as print data to the image output unit 30, together with bitmap data of pigment-based inks of individual colors.

According to the above-described data processing, it is possible to make favorably different a proportion of the treatment liquid applied to a position to which pigment-based inks are applied, depending on a contact angle of pigment-based inks with respect to the treatment liquid. In other words, it is possible to control an amount of applying the treatment liquid in such a manner that a proportion of an amount of applying the treatment liquid to that of applying pigment-based inks relatively small in contact angle is made smaller than a proportion of an amount of applying the treatment liquid to that of applying pigment-based inks relatively great in contact angle. Thereby, pigment-based inks small in contact angle are made smaller than pigment-based inks great in contact angle in a proportion of an amount of applying the treatment liquid to that of applying pigment-based inks. It is, thus, possible to suppress an amount of applying the treatment liquid to a minimum necessary extent.

Evaluation

Next, the effect of the present embodiment will be verified. Hereinafter, there are formed a plurality of evaluation images made different in proportion of an amount of applying the treatment liquid to that of applying pigment-based inks. These evaluation images are confirmed individually for fastness of a printed image and a proportion of an amount of applying the treatment liquid necessary for obtaining a sufficient fastness of a printed image is determined for every ink group different in contact angle. Then, it is verified that the sufficient fastness of a printed image is to be obtained, even if a proportion of an amount of applying the treatment liquid to that of applying pigment-based inks is made smaller in pigment-based inks small in contact angle than in pigment-based inks great in contact angle. In this instance, the fastness of a printed image is defined as scratch resistance. The scratch resistance has been confirmed quantitatively for the effect in the following manner.

Scratch resistance may be determined by many methods. As described previously, in the present embodiment, with attention given to damage to an image on "contact with a fingernail," the surface of an image was measured for scratch hardness, by which the scratch resistance was evaluated. A scratch resistance test was conducted by using a surface tester made by Shinto Scientific Co., Ltd. (product name: Heidon Tribogear Type 14DR). This test is actually conducted by procedures in which a vertical load is given to a scratch needle (in general, a sapphire or a diamond point) to determine the scratch hardness by referring to the dimension of scar width on scratching.

In the present embodiment, for the purpose of obtaining a scar close to damage to an image on "contact with a fingernail," a resin ball (4 mmϕ) of polymethyl methacrylate (PMMA) was used as a friction member. The resin ball was fixed to a ball indenter holder, pressed vertically to the surface of an image, and moved on the surface of the image at a speed of 40 mm/sec. A state of the scar made when the vertical load to the resin ball was increased in a stepwise manner was evaluated subjectively on the basis of the criteria given below. The criteria were standardized so as to correspond to a state of the scar made when actually scratched with a human fingernail.

o: found no scar resulting from peeling of image at vertical load of 500 g or less (no scar resulting from peeling of image even when the image is repeatedly scratched by a human fingernail)

x: found scar resulting from peeling of image at vertical load of 200 g or less (scar resulting from peeling of image when the image is scratched just by a human fingernail)

Evaluation images were formed by using the previously described inkjet printing apparatus to apply the treatment liquid respectively to pigment-based inks of black and light cyan. Specifically, as shown in FIG. 9, the pigment-based inks were given a printing duty of 100% and the treatment liquid was allowed to vary in printing duty from 0% to 100%, thereby forming individual evaluation images. Then, the evaluation images in which the treatment liquid was allowed to vary in printing duty were individually evaluated by the tester (Heidon) and by a human fingernail, thereby confirming the effect of the scratch resistance by the treatment liquid.

FIG. 9 is a table showing the results obtained by evaluating the evaluation images for scratch resistance. A sufficient scratch resistance is obtained for black ink great in contact angle when the treatment liquid is applied in an amount corresponding to 60% or more of that of the black ink. On the other hand, a sufficient scratch resistance is obtained for light cyan ink small in contact angle when the treatment liquid is applied in an amount corresponding to 20% or more of that of the light cyan ink. It has been, therefore, found that a sufficient scratch resistance is obtained even when pigment-based inks small in contact angle are decreased in amount of the treatment liquid in contact with pigment-based inks, as compared with pigment-based inks great in contact angle.

Further, conventionally, in order to correspond completely to an image area of pigment-based inks, the treatment liquid was given a printing duty of 100%. The treatment liquid has been found sufficiently effective in a printing duty of less than 100% as shown in the present embodiment.

FIG. 10 is a table showing an optimal use amount of the treatment liquid depending on a difference in wettability. Pigment-based inks used in forming an image are classified into a group great in contact angle, the representative example of which is black ink, and a group small in contact angle, the representative example of which is light cyan ink. Therefore, it has been found that a printed image of pigment-based inks can be coated completely with the treatment liquid, if the treatment liquid is ejected to image data of a group great in contact angle in an amount corresponding to 60% of that of the pigment-based inks and if it is ejected to image data of a group small in contact angle in an amount corresponding to 20% of that of the pigment-based inks. Therefore, in using the inks of the present embodiment, a proportion of an amount of applying the treatment liquid to that of applying pigment-based inks is optimally set to be 60% for a group great in contact angle and 20% for a group small in contact angle.

As described so far, even if a proportion of an amount of applying the treatment liquid is made small to decrease an amount of applying the treatment liquid for a group of pigment-based inks relatively small in contact angle with respect to the treatment liquid, it is possible to allow the effect of scratch resistance to be sufficiently exhibited. Further, the present invention is able to realize an inkjet apparatus low in running cost, with consumption of the treatment liquid kept to a low level, as compared with a conventional inkjet apparatus using the treatment liquid. Still further, an amount of applying the treatment liquid is decreased to result in a decrease of total water content in the pigment-based inks and the treatment liquid, thus making it possible to reduce the drying time.

It is noted that the treatment liquid applicable in the present embodiment shall not be limited to the above composition, and any treatment liquid may be used as long as it is a material which improves the scratch resistance of a pigment-based ink image layer.

Further, in the present embodiment, the treatment liquid for improving functions of the scratch resistance is shown as an example. However, the treatment liquid applicable in the present embodiment shall not be limited to the above-described scratch resistance liquid. Any treatment liquid is acceptable as long as it is able to improve the performance of a pigment-based ink image, for example, image quality such as gloss uniformity, light source dependency, or bronzing, and fastness of a printed image such as UV property, water resistance, alkali resistance or weatherability, in addition to the functions of scratch resistance. With the above description taken into account, the treatment liquid applicable in the present invention is defined as an image-performance improving liquid.

Further, in the present embodiment, used is glossy paper which is, in general, a combination low in scratch resistance with regard to pigment-based inks. The present invention shall not be, however, limited to this combination. Other printing media such as matt-coated paper and plain paper may be used.

Other Embodiments

In the above embodiment, pigment-based inks used in forming an image are classified into two groups, that is, a group small in contact angle and a group great in contact angle, depending on a difference in contact angle. The number of classifications shall not be limited to two groups. The inks may be classified into a larger number of groups for each ink according to the degree of the contact angle (for example, 3 groups, 4 groups, etc.). Even in this instance, as with the above-described embodiment, a proportion of an amount of applying the treatment liquid is made different in each group, depending on the contact angle. For example, where the inks are classified into 4 groups, there may be provided four types of treatment-liquid applying patterns different in duty respectively corresponding to these 4 groups.

Further, in the above-described embodiment, besides the pigment-based inks used in forming an image, separately used is the treatment liquid for improving the image performance (scratch resistance in the above-described embodiment) of these pigment-based inks. Therefore, the treatment liquid is preferably available in an almost colorless transparent state, because it is, in principle, used independently of forming an image. Although colored, a material capable of improving functions such as scratch resistance may be added to some or all of light-colored pigment-based inks such as light cyan ink, light magenta ink and light gray ink, among pigment-based inks used in forming an image, so that the material may be involved both in formation of an image and improvement of functions. In this instance, needed are no additional components covering one color pigment-based ink such as an ink tank and a print head, thus greatly contributing to a miniaturization of the apparatus and reduction in cost. As a matter of course, among pigment-based inks used in forming an image, some or all of dark-colored pigment-based inks may also be used as the treatment liquid.

Further, the treatment liquid may be ejected on a printing medium prior to formation of an image and present under a pigment-based ink image layer, or ejected together with pigment-based inks in the midst of forming an image and present inside the pigment-based ink image layer. The treatment liquid may be ejected after complete formation of an image and present on the uppermost surface of the pigment-based ink image layer. As described so far, the present invention shall not be limited to an order of applying the treatment liquid and pigment-based inks or a position at which the treatment liquid is present.

Further, in the above-described embodiment, pigment-based inks used in forming an image are classified according to a difference in value of wettability (contact angle) with respect to the treatment liquid, and treatment liquid applying data corresponding to the image concerned is to be decided depending on the data amount of the pigment-based ink concerned. However, such an embodiment is acceptable that a proportion of the treatment liquid applying data is changed according to types of printing media (types of the receiving layer such as a high absorption receiving layer or use-specific types such as glossy paper and matt-coated paper). Such an embodiment is also acceptable that a proportion of the treatment liquid applying data is changed according to types of printing modes (a draft mode and a high resolution mode).

Still further, the present invention is applicable to all printing apparatuses in which printing media such as paper, cloth, non-woven cloth, and OHP film are used. Applicable apparatuses include, for example, office automation devices such as printers, copiers and facsimile machines as well as mass production machines.

Figure 12:
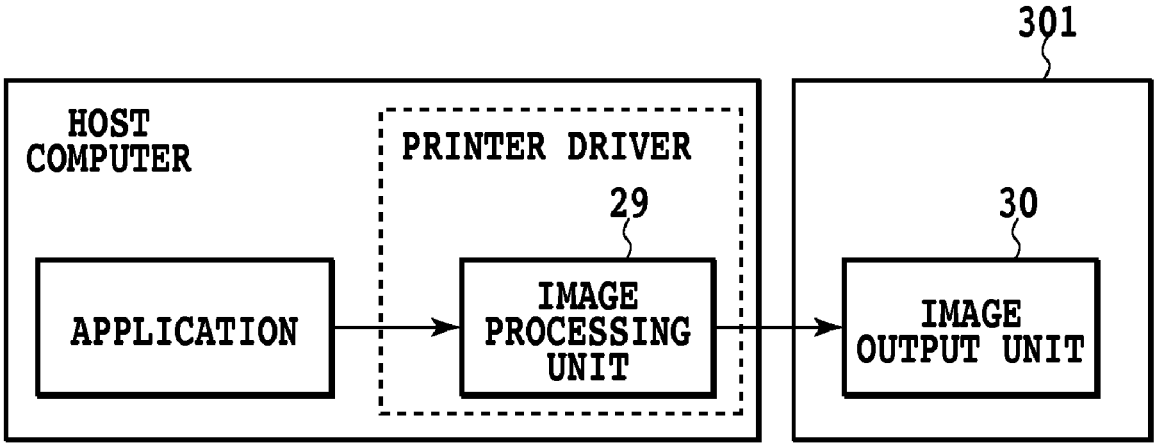
FIG. 12 is a view showing a brief constitution of an inkjet printing system applicable to the present invention.

In addition, in the above-described embodiment, a description was given of an embodiment in which an image processing unit 29 which performs characteristic processing of the present invention is provided inside the inkjet printing apparatus. The image processing unit 29 is not necessarily provided inside the inkjet printing apparatus. For example, as shown in FIG. 12, a printer driver of a host computer connected to the inkjet printing apparatus is allowed to have the function of the image processing unit 29. In this instance, the printer driver generates pigment-based ink applying data and treatment liquid applying data on the basis of multi-valued image data received from an application, thereby supplying the data to a printing apparatus 301. As described above, the present invention is also applicable to an inkjet printing system constituted so as to include the host computer and the inkjet printing apparatus 301.

In this instance, the host computer functions as a data supplying apparatus for supplying data to the inkjet printing apparatus and also functions as a control device for controlling the inkjet printing apparatus.

Further, the present invention is characterized by data processing executed by the image processing unit 29. Therefore, the present invention is also applicable to a data generating apparatus equipped with the image processing unit 29 for performing characteristic data processing of the present invention. Where the image processing unit 29 is provided at an inkjet printing apparatus, the inkjet printing apparatus functions as a data generating apparatus of the present invention, and where the image processing unit 29 is provided at a host computer, the host computer functions as the data generating apparatus of the present invention.

Still further, the present invention is also applicable to computer programs for allowing a computer to execute the above-described characteristic data processing and also to a storage medium which stores the programs so as to be read by the computer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2007-329338, filed Dec. 20, 2007, 2008-302847, filed Nov. 27, 2008, which are hereby incorporated by reference herein in their entirety.

What is claimed is:

1. An inkjet printing apparatus for printing an image by applying a plurality of pigment inks and a treatment liquid, for improving a performance of the image formed by the plurality of pigment inks, to a printing medium, comprising:

a print unit for applying (i) a first pigment ink, which has a first contact angle with respect to the treatment liquid, (ii) a second pigment ink, which has a second contact angle, larger than the first contact angle, with respect to the treatment liquid, and (iii) the treatment liquid; and a controller configured to control an applying amount of the treatment liquid so that a first proportion of an applying amount of the treatment liquid to the first pigment ink is smaller than a second proportion of an applying amount of the treatment liquid to the second pigment ink.

2. The inkjet printing apparatus according to claim 1, wherein the controller comprises a generation unit configured to:

(i) generate first treatment liquid application data for applying the treatment liquid to be in contact with the first pigment ink on the basis of first print data for applying the first pigment ink, and (ii) generate second treatment liquid application data for applying the treatment liquid to be in contact with the second pigment ink on the basis of second print data for applying the second pigment ink, and wherein the generation unit generates the first and second treatment liquid application data such that an amount of the treatment liquid applied to a position to which the first pigment ink is applied is made smaller than an amount of the treatment liquid applied to a position to which the second pigment ink is applied.

3. The inkjet printing apparatus according to claim 1, wherein the treatment liquid is colorless.

4. The inkjet printing apparatus according to claim 1, wherein the treatment liquid is colored.

5. The inkjet printing apparatus according to claim 1, wherein the performance of the image is at least one of scratch resistance, weatherability, water resistance, alkali resistance, gloss, haze and bronzing of an image.

6. An inkjet printing method for printing an image by applying a plurality of pigment inks and a treatment liquid, for improving a performance of the image formed by the plurality of pigment inks, to a printing medium, comprising the steps of:

applying the plurality of pigment inks, including a first pigment ink, which has a first contact angle with respect to the treatment liquid, and a second pigment ink, which has a second contact angle, larger than the first contact angle, with respect to the treatment liquid, to the printing medium; and applying the treatment liquid to the printing medium so as to be in contact with the plurality of pigment inks applied to the printing medium, wherein a first proportion of an applying amount of the treatment liquid to the first pigment ink is smaller than a second proportion of an applying amount of the treatment liquid to the second pigment ink.

7. A data generating apparatus for generating data for applying a treatment liquid for improving a performance of an image formed by a plurality of pigment inks, comprising:

a generation unit configured to:

(i) generate first treatment liquid application data for applying the treatment liquid to be in contact with a first pigment ink, which has first contact angle with respect to the treatment liquid, on the basis of first print data for applying the first pigment ink, and (ii) generate second treatment liquid application data for applying the treatment liquid to be in contact with a second pigment ink, which has a second contact angle, larger than the first contact angle, with respect to the treatment liquid, on the basis of second print data for applying the second pigment ink, wherein the generation unit generates the first and second treatment liquid application data such that a first proportion of an applying amount of the treatment liquid to the first pigment ink is smaller than a second proportion of an applying amount of the treatment liquid to the second pigment ink.

8. A non-transitory computer readable storage medium which stores a computer program for instructing a processor to execute a data generation process comprising the steps of:

generating first treatment liquid application data for applying a treatment liquid to be in contact with a first pigment ink, which has a first contact angle with respect to the treatment liquid, on the basis of first print data for applying the first pigment ink; and generating second treatment liquid application data for applying the treatment liquid to be in contact with a second pigment ink, which has a second contact angle, larger than the first contact angle, with respect to the treatment liquid, on the basis of second print data for applying the second pigment ink, wherein the first and second treatment liquid application data are generated such that a first proportion of an applying amount of the treatment liquid to the first pigment ink is smaller than a second proportion of an applying amount of the treatment liquid to the second pigment ink.

9. An inkjet printing system comprising:

an inkjet printing apparatus, comprising:

a treatment liquid applying unit for applying a treatment liquid for improving a performance of an image, and a print unit for printing the image by applying a plurality of pigment inks including a first pigment ink, which has a first contact angle with respect to the treatment liquid, and a second pigment ink, which has a second contact angle, larger than the first contact angle, with respect to the treatment liquid; and a data supplying apparatus for supplying data to the inkjet printing apparatus, comprising:

a generation unit configured to:

(i) generate first treatment liquid application data for applying the treatment liquid to be in contact with the first pigment ink on the basis of first print data for applying the first pigment ink, and (ii) generate second treatment liquid application data for applying the treatment liquid to be in contact with the second pigment ink on the basis of second print data for applying the second pigment ink, wherein the generation unit generates the first and second treatment liquid application data such that a first proportion of the treatment liquid to the first pigment ink is smaller than a second proportion of the treatment liquid to the second pigment ink, and a supply unit for supplying to the inkjet printing apparatus the first and second treatment liquid application data generated by the generation unit.

* * * * *